US010619822B1

(12) United States Patent
Hsu

(10) Patent No.: US 10,619,822 B1
(45) Date of Patent: Apr. 14, 2020

(54) ART LAMP WITH OPTICAL APPLICATION

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/507,095

(22) Filed: Jul. 10, 2019

(51) Int. Cl.

| | |
|---|---|
| ***F21S 13/10*** | (2006.01) |
| ***F21V 3/00*** | (2015.01) |
| ***F21V 5/00*** | (2018.01) |
| ***F21V 17/08*** | (2006.01) |
| ***F21V 3/04*** | (2018.01) |
| ***F21V 19/00*** | (2006.01) |
| ***F21V 17/00*** | (2006.01) |
| *F21Y 115/10* | (2016.01) |
| *F21W 121/00* | (2006.01) |

(52) U.S. Cl.
CPC ..... *F21V 5/00* (2013.01); *F21V 3/04* (2013.01); *F21V 17/002* (2013.01); *F21V 17/08* (2013.01); *F21V 19/003* (2013.01); *F21W 2121/00* (2013.01); *F21Y 2115/10* (2016.08)

(58) Field of Classification Search
CPC ..... F21V 3/04–049; F21V 5/00–005; F21V 17/002–08; F21V 19/003; F21W 2121/00; F21Y 2115/10
USPC ..... 362/235–248, 311.01–311.1, 326–329, 362/363, 520–522
See application file for complete search history.

(56) References Cited

U.S. PATENT DOCUMENTS 1,472,639 A * 10/1923 Dorey ..... F21S 13/00 362/331

* cited by examiner

*Primary Examiner* — Jason M Han
(74) *Attorney, Agent, or Firm* — Alan D. Kamrath; Mayer & Williams PC

(57) ABSTRACT

An art lamp includes a mounting disk, a light source module mounted on the mounting disk, an inner lampshade surrounding the light source module, and an outer lampshade surrounding the inner lampshade. The inner lampshade includes a main body and a plurality of locking portions. The locking portions are locked onto the mounting disk. The main body has a plurality of diamond cones extending downward. Each of the diamond cones is provided with a plurality of light output faces that are inclined and directed toward different directions. The outer lampshade includes a fitting frame, a plurality of ornament units, and a plurality of connecting members. The fitting frame is mounted on the mounting disk. Each of the ornament units includes an outer ring, and a plurality of crystals.

6 Claims, 4 Drawing Sheets

ART LAMP WITH OPTICAL APPLICATION

BACKGROUND OF THE INVENTION

1. Field of the Invention

The present invention relates to an illuminating apparatus and, more particularly, to an art lamp (or a ceiling light) with an optical application.

2. Description of the Related Art

A conventional ceiling fitting is mounted on the ceiling of a house room to provide an illuminating function. In general, the conventional ceiling fitting is affixed to the ceiling by a plurality of fasteners, such as screws or expansion bolts, during the assembling process. The conventional ceiling fitting includes a mounting disk attached to the ceiling, a light emitting member (such as an LED) mounted in the mounting disk, and a lampshade mounted on the mounting disk and covering the light emitting member. However, the lampshade has a curved face with a constant curvature, such that the lampshade only provides a monotonous lighting effect and cannot satisfy the consumer's diverse requirements. In addition, the lampshade has a single structure, thereby decreasing the aesthetic quality of the ceiling fitting.

BRIEF SUMMARY OF THE INVENTION

The primary objective of the present invention is to provide an art lamp with an optical application.

In accordance with the present invention, there is provided an art lamp comprising a mounting disk, a light source module, an inner lampshade, and an outer lampshade. The light source module is mounted on a bottom face of the mounting disk. The inner lampshade is mounted on the bottom face of the mounting disk and surrounds the light source module. The inner lampshade includes a main body and a plurality of locking portions arranged on a periphery of the main body. The locking portions of the inner lampshade are locked onto the mounting disk. The main body of the inner lampshade has a lower surface provided with a plurality of diamond cones extending downward. Each of the diamond cones of the main body is provided with a plurality of light output faces that are inclined and directed toward different directions. The outer lampshade is mounted on the bottom face of the mounting disk and surrounds the inner lampshade. The outer lampshade includes a fitting frame, a plurality of ornament units, and a plurality of connecting members. The fitting frame is mounted on the mounting disk. Each of the ornament units includes an outer ring, and a plurality of crystals mounted in the outer ring. The outer rings of the ornament units are connected with each other to construct an integrity. The crystals of adjacent two of the ornament units are detachably connected by one of the connecting members.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
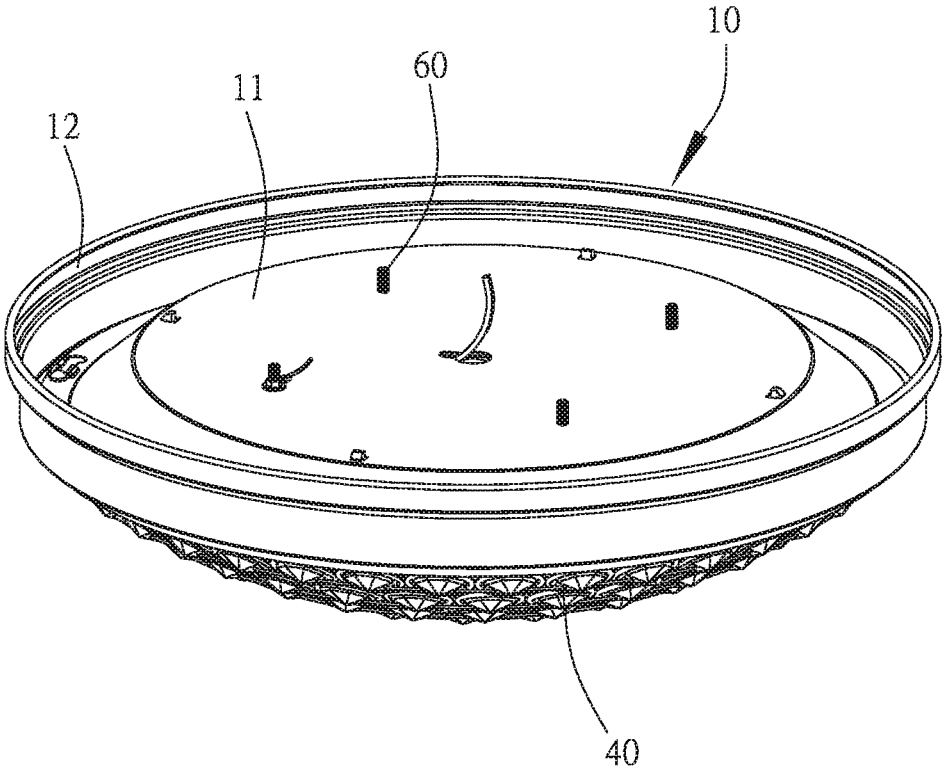
FIG. 1 is a perspective view of an art lamp in accordance with the preferred embodiment of the present invention.
Figure 2:
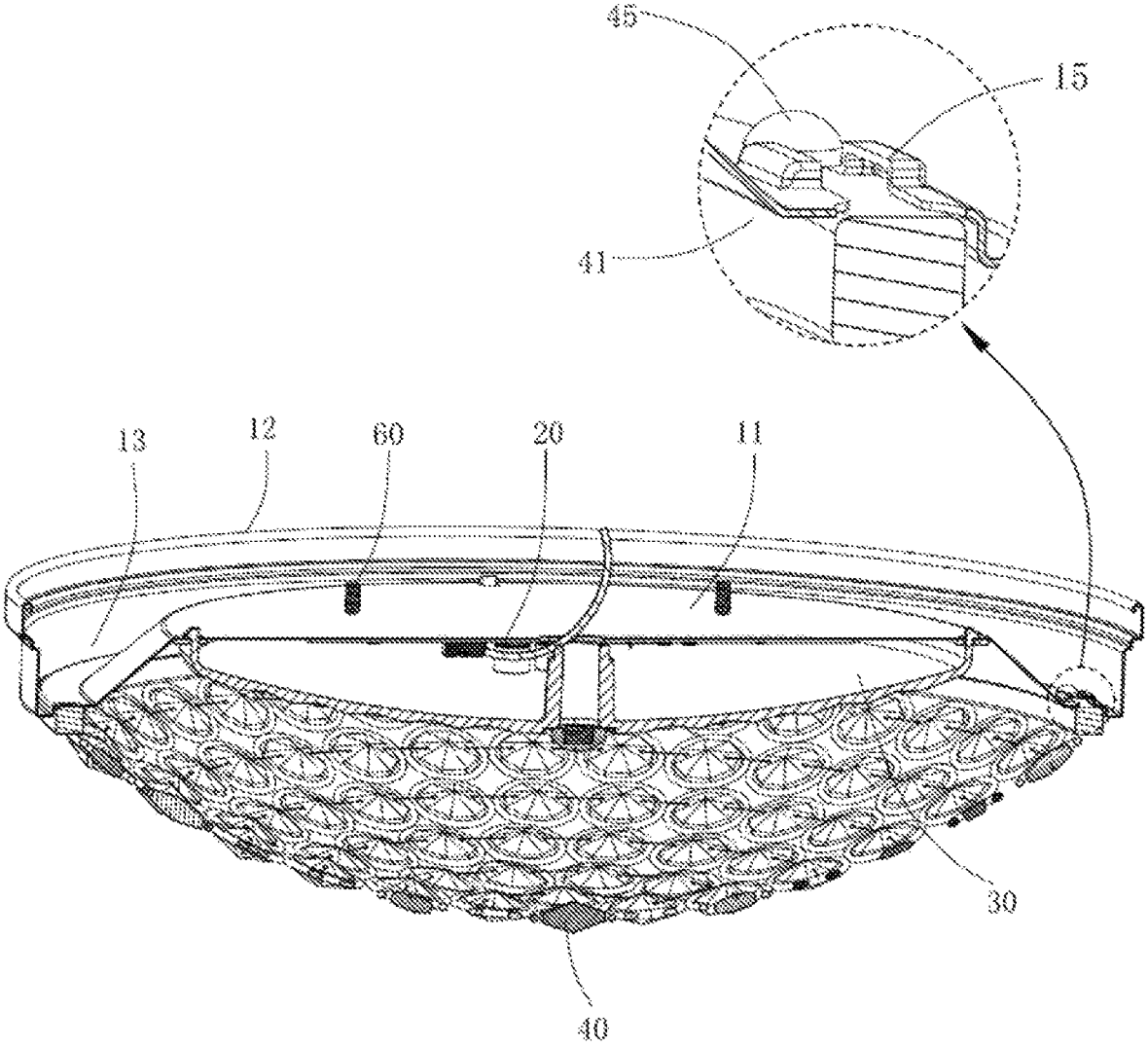
FIG. 2 is a perspective cross-sectional view of the art lamp as shown in FIG. 1.
Figure 3:
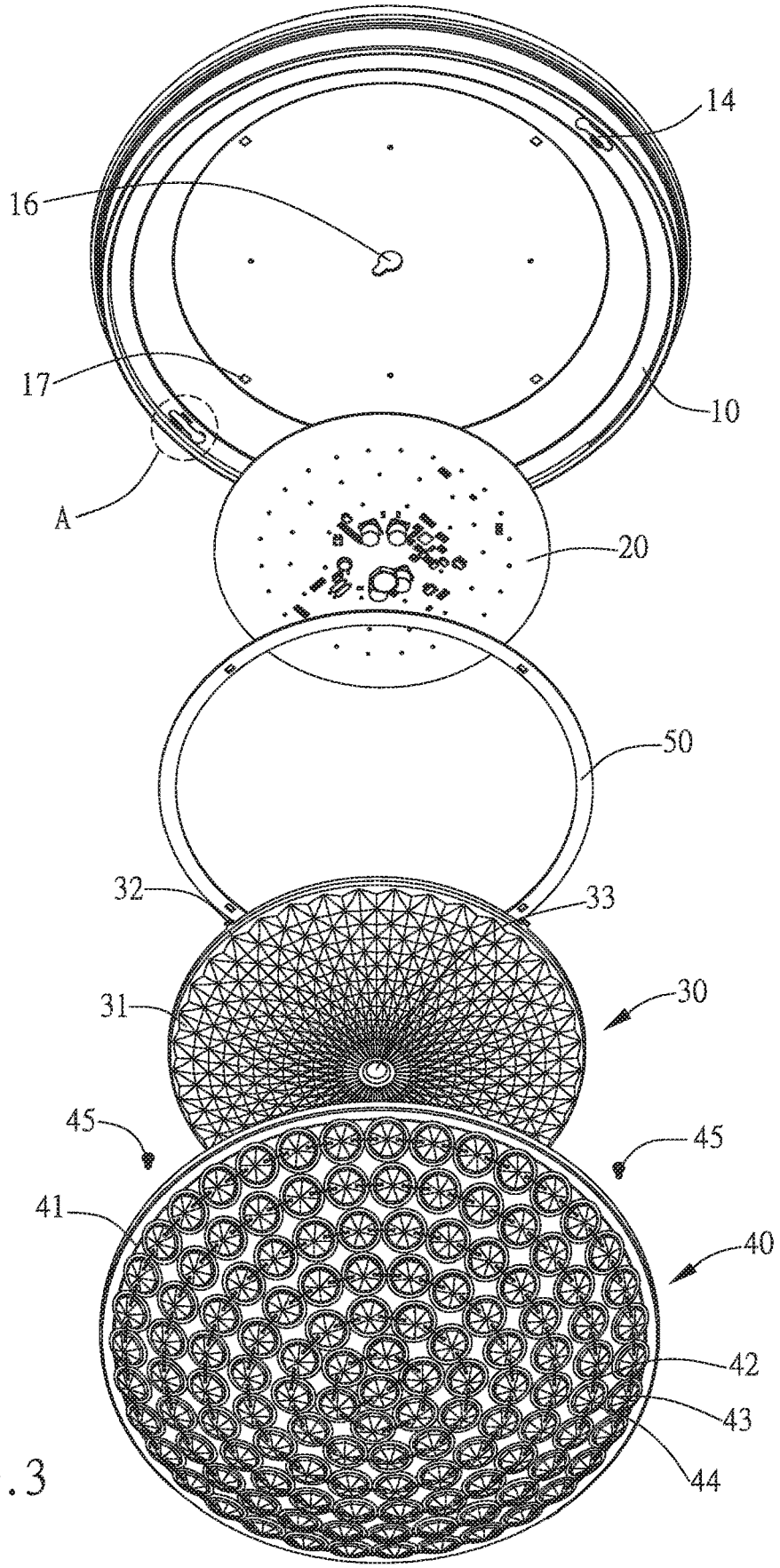
FIG. 3 is an exploded perspective view of the art lamp as shown in FIG. 1.
Figure 4:
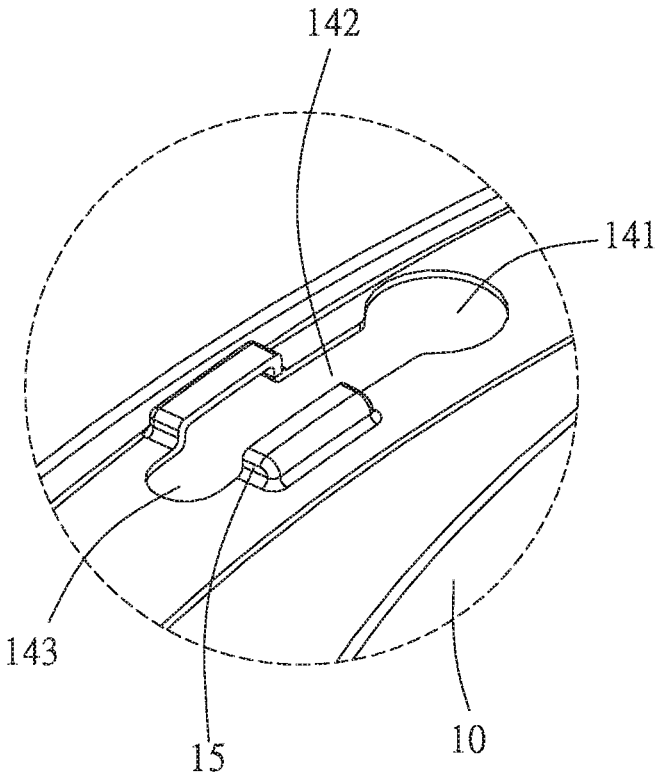
FIG. 4 is a partial enlarged view of a mounting disk of the art lamp taken along mark "A" as shown in FIG. 3.

Referring to FIGS. 1-4, an art lamp in accordance with the preferred embodiment of the present invention comprises a mounting disk (or ceiling disk or mounting bracket) 10, a light source module 20, an inner lampshade 30, and an outer lampshade 40.

The light source module 20 is mounted on a bottom face of the mounting disk 10.

The inner lampshade 30 is mounted on the bottom face of the mounting disk 10 and surrounds the light source module 20. The inner lampshade 30 includes a main body 31 and a plurality of locking portions 32 arranged on a periphery of the main body 31. The locking portions 32 of the inner lampshade 30 are locked onto the mounting disk 10. The main body 31 of the inner lampshade 30 has a lower surface provided with a plurality of diamond cones extending downward. Each of the diamond cones of the main body 31 is provided with a plurality of (preferably four) light output faces that are inclined and directed toward different directions. In such a manner, the light output faces of the diamond cones have interactions, such as reflection, refraction or the like, to enlarge the light output area, so as to enhance the light output effect. For example, the light output faces of the diamond cones are like the crystals and have optical radiating effects.

The outer lampshade 40 is mounted on the bottom face of the mounting disk 10 and surrounds the inner lampshade 30. The outer lampshade 40 includes a fitting frame 41, a plurality of ornament units, and a plurality of connecting members 42. The fitting frame 41 is mounted on the mounting disk 10. Each of the ornament units includes an outer ring 43, and a plurality of crystals 44 mounted in the outer ring 43. The outer rings 43 of the ornament units are connected with each other to construct an integrity. The crystals 44 of adjacent two of the ornament units are detachably connected by one of the connecting members 42.

In the preferred embodiment of the present invention, the mounting disk 10 has a central portion provided with a protruding platform 11 and has a periphery provided with an outer flange 12. The outer flange 12 of the mounting disk 10 surrounds the protruding platform 11. The mounting disk 10 is provided with a groove 13 defined between the protruding platform 11 and the outer flange 12. The mounting disk 10 is provided with a plurality of mounting slots 14. The mounting slots 14 of the mounting disk 10 are arranged in a bottom of the groove 13. The outer lampshade 40 is provided with a plurality of restriction members 45 locked in the mounting slots 14 of the mounting disk 10 respectively.

In the preferred embodiment of the present invention, each of the mounting slots 14 includes an entrance 141, a guide portion 142, and a positioning portion 143. The guide portion 142 of each of the mounting slots 14 is arranged between and connected to the entrance 141 and the positioning portion 143. The entrance 141 of each of the mounting slots 14 has a diameter greater than that of the guide portion 142 and greater than that of the positioning portion 143. Each of the restriction members 45 is inserted into the entrance 141, is guided through the guide portion 142 into the positioning portion 143, and is positioned in the positioning portion 143 of each of the mounting slots 14.

In the preferred embodiment of the present invention, each of the mounting slots 14 is provide with two protruding stop portions 15 extending upward. The two protruding stop portions 15 of each of the mounting slots 14 are formed on two sidewalls of the guide portion 142, and are arranged between the entrance 141 and the positioning portion 143. Each of the restriction members 45 has a top provided with a limit portion which is limited by the two protruding stop portions 15 of each of the mounting slots 14. The limit portion of each of the restriction members 45 is enlarged.

In assembly, a mounting gap is defined between the limit portion of each of the restriction members 45 and the top face of the mounting disk 10. Thus, when the restriction members 45 are moved upward by pushing the outer lampshade 40 toward the mounting disk 10, the limit portion of each of the restriction members 45 is inserted into the entrance 141. Then, the outer lampshade 40 is rotated relative to the mounting disk 10, such that the limit portion of each of the restriction members 45 is guided through the guide portion 142 and the two protruding stop portions 15 into the positioning portion 143 of each of the mounting slots 14. Then, the outer lampshade 40 is pulled downward, such that the limit portion of each of the restriction members 45 is retained by the two protruding stop portions 15 of each of the mounting slots 14, and each of the restriction members 45 is positioned in and will not be detached from the positioning portion 143 of each of the mounting slots 14.

In the preferred embodiment of the present invention, the light source module 20 includes a circuit board, and a plurality of light emitting members mounted on a bottom face of the circuit board. Preferably, each of the light emitting members is an LED. The art lamp further comprises a plurality of fasteners 60 extending through the circuit board of the light source module 20 and secured to the protruding platform 11 of the mounting disk 10, to secure the circuit board of the light source module 20 to a bottom face of the protruding platform 11, such that the light source module 20 is affixed to the mounting disk 10.

In the preferred embodiment of the present invention, the crystals 44 of each of the ornament units are provided with a plurality of through holes, and each of the connecting members 42 has two ends each mounted in one of the through holes of one of the ornament units.

In the preferred embodiment of the present invention, the art lamp further comprises a washer (or an O-ring) 50 mounted between the mounting disk 10 and the inner lampshade 30, such that the inner lampshade 30 is mounted on the mounting disk 10 steadily.

In the preferred embodiment of the present invention, the protruding platform 11 of the mounting disk 10 is provided with a fastening hole 16 and a plurality of locking holes 17. The fastening hole 16 is located at the central portion of the mounting disk 10, and the locking holes 17 surround the fastening hole 16. The locking portions 32 of the inner lampshade 30 are locked in the locking holes 17 of the mounting disk 10.

In the preferred embodiment of the present invention, the main body 31 of the inner lampshade 30 has a central portion provided with a perforation 33, and the diamond cones of the main body 31 are diffused radially and outwardly from the perforation 33 and are arranged regularly.

In the preferred embodiment of the present invention, each of the connecting members 42 is a metal wire, as thread or a cord.

In the preferred embodiment of the present invention, the crystals 44 are provided with a plurality of diamond cones protruding outward. Each of the diamond cones of the crystals 44 is provided with a plurality of light output faces that are inclined and directed toward different directions. In such a manner, the light output faces of the diamond cones have interactions, such as reflection, refraction or the like, to enlarge the light output area, so as to enhance the light output effect. In addition, light permeating clearances are defined between the crystals 44 to allow permeation of the rays of the inner lampshade 30.

In the preferred embodiment of the present invention, the art lamp further comprises a threaded mounting post having an upper end attach to the ceiling, and a lower end extending through the fastening hole 16 of the mounting disk 10 and the perforation 33 of the inner lampshade 30, and a nut screwed onto the lower end of the mounting post and resting on the inner lampshade 30.

Accordingly, the inner lampshade 30 increases the light output area of the optical rays, thereby greatly enhancing the brightness of the art lamp. In addition, the outer lampshade 40 further refracts the light beams from the inner lampshade 30, to enhance the lighting effect of the art lamp. Further, the outer lampshade 40 is formed with a light permeable gap, such that the light beams of the inner lampshade 30 are emitted from the light permeable gap of the outer lampshade 40, to present a particular light output effect. Further, the crystals 44 are arranged detachably, to enhance the diversity of the art lamp.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A art lamp comprising:

a mounting disk, a light source module, an inner lampshade, and an outer lampshade;

wherein:

the light source module is mounted on a bottom face of the mounting disk;

the inner lampshade is mounted on the bottom face of the mounting disk and surrounds the light source module;

the inner lampshade includes a main body and a plurality of locking portions arranged on a periphery of the main body;

the locking portions of the inner lampshade are locked onto the mounting disk;

the main body of the inner lampshade has a lower surface provided with a plurality of diamond cones extending downward;

each of the diamond cones of the main body is provided with a plurality of light output faces that are inclined and directed toward different directions;

the outer lampshade is mounted on the bottom face of the mounting disk and surrounds the inner lampshade;

the outer lampshade includes a fitting frame, a plurality of ornament units, and a plurality of connecting members;

the fitting frame is mounted on the mounting disk;

each of the ornament units includes an outer ring, and a plurality of crystals mounted in the outer ring;

the outer rings of the ornament units are connected with each other to construct an integrity; and the crystals of adjacent two of the ornament units are detachably connected by one of the connecting members.

2. The art lamp of claim 1, wherein:

the mounting disk has a central portion provided with a protruding platform and has a periphery provided with an outer flange;

the outer flange of the mounting disk surrounds the protruding platform;

the mounting disk is provided with a groove defined between the protruding platform and the outer flange;

the mounting disk is provided with a plurality of mounting slots;

the mounting slots of the mounting disk are arranged in a bottom of the groove; and the outer lampshade is provided with a plurality of restriction members locked in the mounting slots of the mounting disk respectively.

3. The art lamp of claim 2, wherein:

each of the mounting slots includes an entrance, a guide portion, and a positioning portion;

the guide portion of each of the mounting slots is arranged between and connected to the entrance and the positioning portion;

the entrance of each of the mounting slots has a diameter greater than that of the guide portion and greater than that of the positioning portion; and each of the restriction members is inserted into the entrance, is guided through the guide portion into the positioning portion, and is positioned in the positioning portion of each of the mounting slots.

4. The art lamp of claim 3, wherein each of the mounting slots is provide with two protruding stop portions extending upward, and each of the restriction members has a top provided with a limit portion which is limited by the two protruding stop portions of each of the mounting slots.

5. The art lamp of claim 1, wherein the light source module includes a circuit board, and a plurality of light emitting members mounted on a bottom face of the circuit board, and the art lamp further comprises a plurality of fasteners extending through the circuit board of the light source module and secured to the protruding platform of the mounting disk, to secure the circuit board of the light source module to a bottom face of the protruding platform.

6. The art lamp of claim 1, wherein the crystals of each of the ornament units are provided with a plurality of through holes, and each of the connecting members has two ends each mounted in one of the through holes of one of the ornament units.

* * * * *